US005938421A

United States Patent [19]

George, II

[11] Patent Number: 5,938,421

[45] Date of Patent: Aug. 17, 1999

[54] FLAME MOVEMENT METHOD AND SYSTEM

[75] Inventor: Paul E. George, II, Powell, Ohio

[73] Assignee: Gas Research Institute, Chicago, Ill.

[21] Appl. No.: 08/968,002

[22] Filed: Nov. 12, 1997

[51] Int. Cl.[6] ..... F23C 11/04

[52] U.S. Cl. ..... 431/1; 431/12; 431/278; 126/512

[58] Field of Search ..... 431/1, 12, 278; 126/512

[56] References Cited

U.S. PATENT DOCUMENTS

| | | | |
|---|---|---|---|
| 816,154 | 3/1906 | D'Arsi | 431/1 |
| 830,092 | 9/1906 | Matthews et al. | 431/1 |
| 3,291,116 | 12/1966 | Brooks . | |
| 4,869,664 | 9/1989 | Wright et al. . | |
| 4,976,253 | 12/1990 | Beal et al. . | |
| 5,149,263 | 9/1992 | Stouffer . | |
| 5,383,781 | 1/1995 | Stouffer . | |
| 5,445,516 | 8/1995 | Stouffer . | |
| 5,448,969 | 9/1995 | Stuart et al. . | |
| 5,456,594 | 10/1995 | Yap . | |
| 5,546,853 | 8/1996 | Heil et al. . | |
| 5,795,144 | 8/1998 | Tung | 431/1 |

*Primary Examiner*—Carroll B. Dority
*Attorney, Agent, or Firm*—Pauley Petersen Kinne & Fejer

[57] ABSTRACT

A method and system to generate or provide a moving flame such as to create a varied flame pattern are provided. One or more flow switching devices joined in parallel are utilized to alter the flame port fuel supply such as to produce a moving flame or produce an apparently random flame movement.

26 Claims, 4 Drawing Sheets

FLAME MOVEMENT METHOD AND SYSTEM

BACKGROUND OF THE INVENTION

This invention relates generally to the burning of a fuel and, more particularly, to the burning of a fuel in the form of a fluid to generate a moving flame such as to create a varied flame pattern.

Fireplace assemblies that rely on the burning of a gaseous fuel, such as natural gas composed primarily of methane gas, are well known. The use of gas log sets in such fireplace assemblies is also well known.

In general, gas log sets usually include some form of a gas burner, such as composed of one or more flame ports, whereat the gas fuel is burned, such as in a known manner. Commonly, burners in such sets are associated with simulated wood logs to simulate the appearance and, desirably, the environment, resulting from and associated with a natural wood-burning fire. The gas burners typically employed in such assemblies, similar to the gas burners of the type commonly employed in gas stoves, issue forth a flame of relatively uniform height.

While the popularity of gas-fueled or -fired fireplaces has grown as a result of factors such as convenience, ease of operation, safety, etc., there is a desire to make the fires produced in such gas-fired fireplaces more closely approximate the nature of the fire produced in wood-burning fireplaces. To that end, there is a desire for a gas-fired fireplace assembly which produces flames that exhibit a varied pattern such as more typically occurs in a wood-burning fireplace.

SUMMARY OF THE INVENTION

A general object of the invention is to provide an improved method and system for producing a moving flame.

A more specific objective of the invention is to overcome one or more of the problems described above.

The general object of the invention can be attained, at least in part, through a method for producing a moving flame wherein a fluid fuel is passed through a fuel supply system which includes at least a first flow switching device to alternately supply fuel to one of at least two flame ports.

The prior art fails to provide a method and system for producing an apparently random flame movement such as may be desired for a fluid fuel burning fire such as a natural gas-burning fire such as utilized in gas-fired fireplaces and as may be desired such as to more closely approximate the nature of fires produced in wood-burning fireplaces.

The invention further comprehends a method for producing an apparently random flame movement for a natural gas-fueled fireplace. The method includes the steps of:

providing each of a plurality of flame ports with a varying flow of natural gas through a network including a plurality of fluidic switching devices wherein each fluidic switching device is joined in parallel to at least one of the other of the plurality of fluidic switching devices and burning provided natural gas at each of the plurality of flame ports.

The invention still further comprehends a system for producing a moving flame. The system includes at least first and second flame ports supplied with fluid fuel through a network of at least first and second fluidic switching devices joined in parallel.

The invention yet still further comprehends an improvement in a fireplace having a system wherein natural gas is burned to produce flames at least first and second flame ports. The system improvement relates to the inclusion of at least first and second fluidic switching devices joined in parallel to vary the quantity of the natural gas supplied to at least the first and second flame ports at any one time.

As used herein, references to "fluidic flip-flops" and the like are to be understood to refer to fluidic flow switching devices which switch the channel through which flow is directed in response to an external stimulus.

Further, references herein to "fluidic oscillators" and the like are to be understood to refer to fluidic flow switching devices which self-contained devices switch the channel through which flow is directed automatically without any external stimulus.

Other objects and advantages will be apparent to those skilled in the art from the following detailed description taken in conjunction with the appended claims.

BRIEF DESCRIPTION OF THE DRAWINGS

The above-mentioned and other features and objects of this invention will be better understood from the following detailed description taken in conjunction with the drawings wherein.

DETAILED DESCRIPTION OF THE INVENTION

The present invention, as is described in more detail below, provides an improved method and system for producing a moving flame such as may be desired for a gas-fired fireplace assembly. The invention will be described below with particular reference to systems which burn natural gas. It is to be understood, however, that the invention, in its broader application, is not so limited and may, if desired, be used in or as a part of systems which burn other kinds of fluid fuels, i.e., fuels in the form of a fluid such as in either or both gaseous and liquid form.

Figure 1:
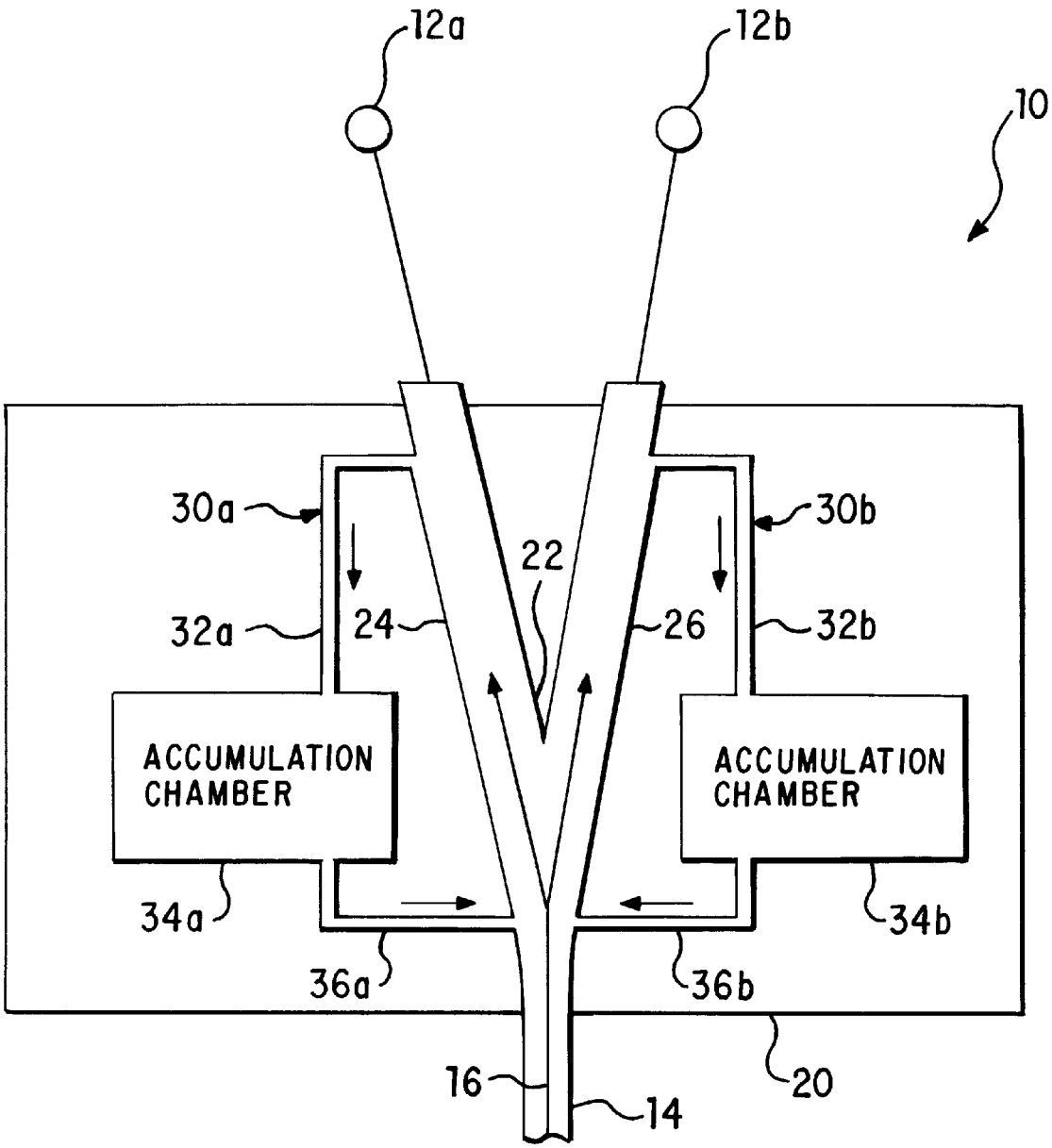
FIG. 1 is a schematic illustration of a flow switching device useable in accordance with one embodiment of the invention to produce a moving flame.

Turning to FIG. 1, there is illustrated a system 10 for producing a moving flame between a first and a second flame port 12*a* and 12*b*, respectively. The system 10 includes a supply line 14, wherethrough a flowstream 16 of fluid fuel, such as of natural gas, is fed to a flow switching device 20 useable in accordance with one embodiment of the invention to produce a moving flame. Those skilled in the art will appreciate that the ignition and burning of such fuel materials at various flame ports is well known in the art and, in the interest of brevity, will not be described or discussed in great detail herein.

The flow switching device 20 is a fluidic switching device, more specifically a bistable fluidic oscillator wherein a splitter 22 causes the fluid flow passing therethrough to split and alternately flow through a first channel 24 and a second channel 26 and vice-versa as a result of fluid flow through the feedback loops 30*a* and 30*b*, respectively.

In the illustrated embodiment, the feedback loops 30*a* and 30*b* each include a flow passage 32*a* and 32*b* which feed into respective accumulation chambers 34*a* and 34*b*. Joining each of the accumulation chambers 34*a* and 34*b*, respectively, with the flowstream 16 are return flowstreams 36*a* and 36*b*, respectively. As a result of flow through the feedback loops 30*a* and 30*b*, respectively, and specifically the return flowstreams 36*a* and 36*b*, respectively, fluid flow in the supply line 14 is alternately directed through first channel 24 and the second channel 26 and vice-versa prior to the splitter 22. As a result, a small amount of fluid flow through the feedback loops 30*a* and 30*b* can cause the fluid flow through the device 20 to switch from the first channel 24 to the second channel 26 and vice-versa.

It will be appreciated that the cycle time or period of time between such switches or alternations can be adjusted such as by adjusting the configuration of the flow switching device 10 such as by adjusting the size of the accumulation chambers 34*a* and 34*b*, as well as by adjusting the configuration of the return flowstreams 36*a* and 36*b* rejoining with the supply line 14.

By causing the flow of natural gas through the device 20 to switch from the first channel 24 to the second channel 26 and vice-versa, the fuel is alternately supplied to the flame ports 12*a* and 12*b*, respectively. Thus, as flames are produced at the flame ports 12*a* and 12*b* only when such fuel ports have been supplied with fuel, the flames issuing forth from the system 10 can be made to move such as to alternately appear issuing forth from the port 12*a* and port 12*b*, respectively.

Figure 2:
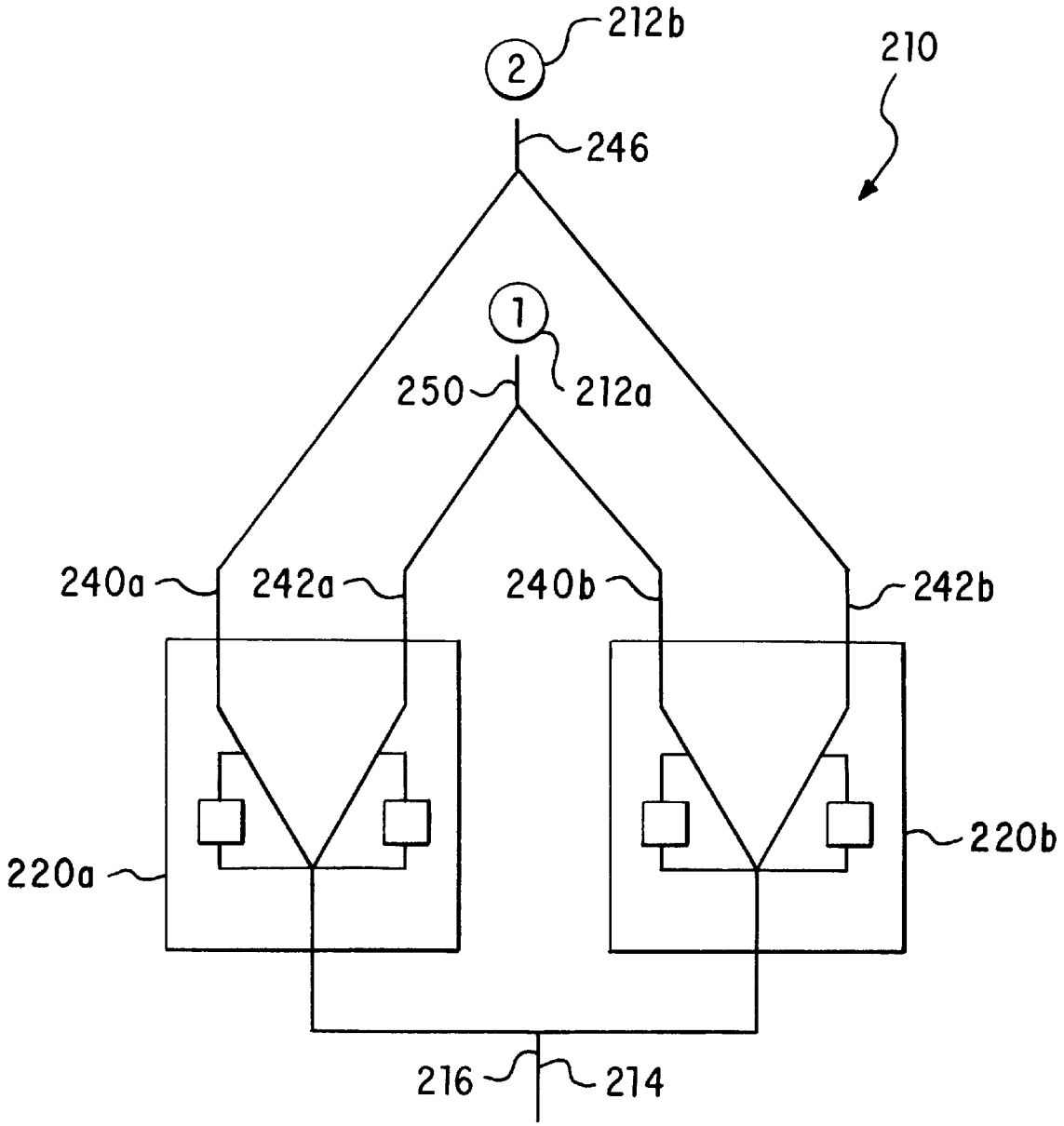
FIG. 2 is a schematic illustration of a system for producing a moving flame in accordance with one embodiment of the invention.

FIG. 2 is a schematic illustration of a system 210 for producing a moving flame between a first and a second flame port 212*a* and 212*b*, respectively, in accordance with one embodiment of the invention wherein first and second flow switching devices 220*a* and 220*b* are joined in parallel. In the system 210, similar to in the system 10 described above, a supply line 214 is provided wherethrough a fluid fuel flowstream 216, such as of natural gas, is fed to the flow switching devices 220*a* and 220*b*, joined in parallel. The flow switching devices 220*a* and 220*b* are generally similar to the flow switching device 20 illustrated in FIG. 1 and described in detail above. Each of the flow switching devices 220*a* and 220*b*, respectively, produces a first natural gas output line 240*a* and 240*b*, respectively, and a second natural gas output line 242*a* and 242*b*, respectively. The first natural gas output line 240*a* issuing forth from the first flow switching device 220*a* is combined with the second natural gas output line 242*b* issuing forth from the second flow switching device 220*b* to form a feed line 246 to the second flame port 212*b*.

In turn, the second natural gas output line 242*a* issuing forth from the first flow switching device 220*a* is combined with the first natural gas output line 240*b* issuing forth from the second flow switching device 220*b* to form a feed line 250 to the first flame port 212*a*.

Moreover, it will be appreciated that the described invention is not limited to such a parallel attachment of flow switching devices. For example, if desired, the first output line 240*a* from the first flow switching device 220*a* can be combined with the first output line 240*b* from the second flow switching device 220*b* while the second output line 242*a* from the first flow switching device 220*a* is joined with the second output line 242*b* of the second flow switching device 220*b*.

In the system 210, the flow switching devices 220*a* and 220*b* can be made to each have a different frequency such that they alternately reinforce the flame at one of the flame ports 212*a* and 212*b* to produce a single larger flame or to form smaller flames at each of the ports, respectively.

In general, systems for producing an apparently random flame movement, such as for a natural gas-fueled fireplace will typically contain at least two or more, typically up to about 40 or more, fluid fuel flow switching devices joined or connected in parallel such as to supply an equal or smaller number of flame ports or flame burner locations composed of several flame ports in close proximity.

In addition, systems for producing an apparently random flame movement such as for a natural gas-fueled fireplace can desirably be arranged in an array such that a fuel port receives fuel flow from two or more flow switching devices. In practice, to enhance the apparent random nature of the flame movement, it is believed desirable that the system have a plurality, preferably most and in some cases a vast majority if not all of the flame ports arranged to receive fuel flow from the output of at least two or more, up to about 6 to 10 such flow switching devices.

Figure 3:
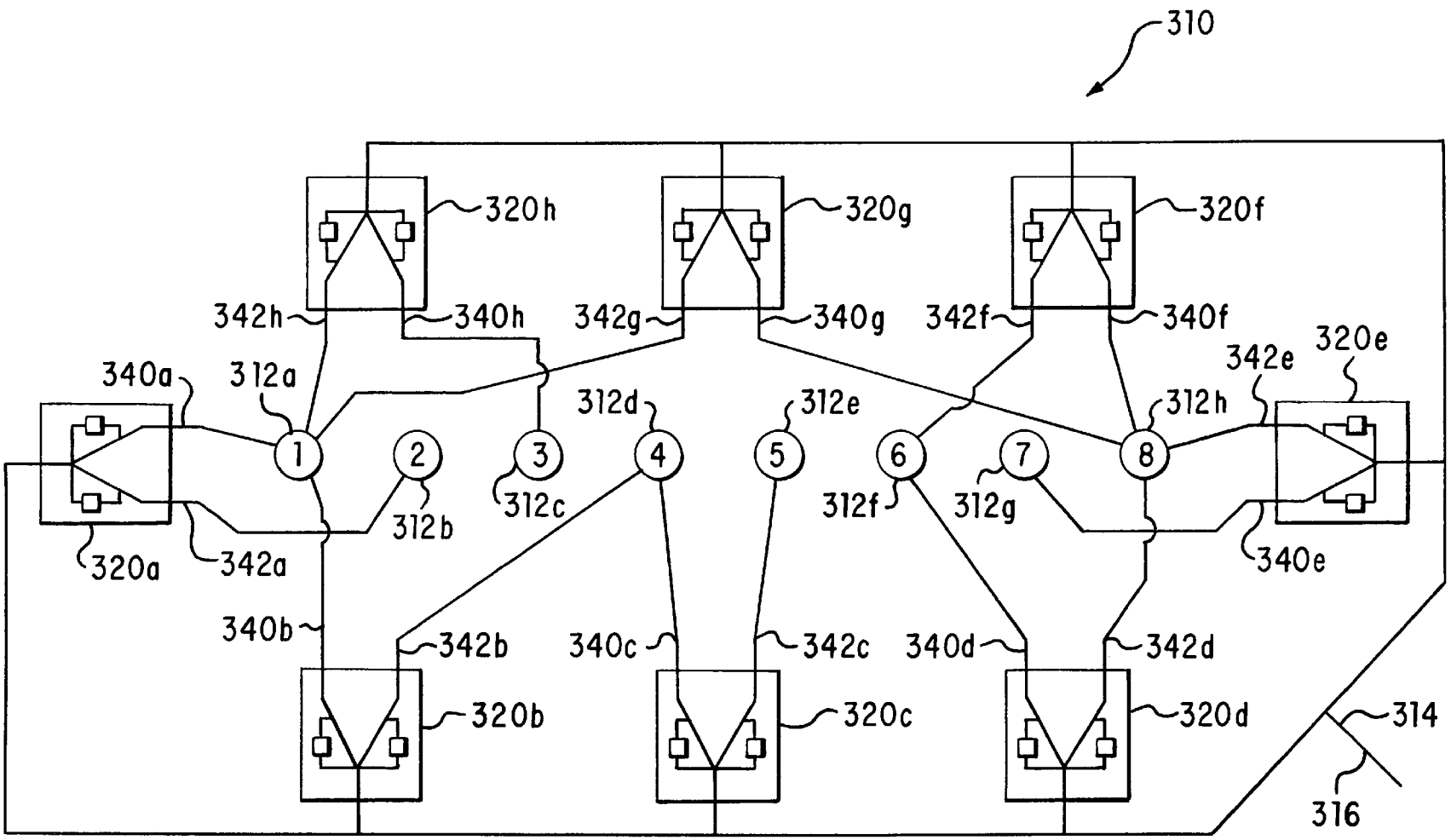
FIG. 3 is a schematic illustration of a system for producing a moving flame in accordance with an alternative embodiment of the invention.

FIG. 3 is a schematic illustration, of a system, designated by the reference numeral 310, for producing a moving flame in accordance with an alternative embodiment of the invention. The system 310, similar to the systems 10 and 210 described above, includes a supply line 314, wherethrough a flowstream 316 of fluid fuel, such as of natural gas, is supplied to a plurality of flame ports, individually designated 312(*a–h*).

The system 310 includes eight flow switching devices 320(*a–h*) of different frequency, such as described above, and includes flame ports which have different number of possible or allowed states. The flow switching devices 320(*a–h*) each have a first natural gas output line 340(*a–h*) and a second natural gas output line 342(*a–h*). The flow switching devices 320(*a–h*) are joined in parallel, as shown and as listed in TABLE A, below.

TABLE A

| DEVICE/OUTPUT | FLAME PORT |
|---|---|
| 320a/340a | 312a |
| 320a/342a | 312b |
| 320b/340b | 312a |
| 320b/342b | 312d |
| 320c/340c | 312d |
| 320c/342c | 312e |
| 320d/340d | 312f |
| 320d/342d | 312h |
| 320e/340e | 312g |
| 320e/342e | 312h |
| 320f/340f | 312h |
| 320f/342f | 312f |
| 320g/340g | 312h |
| 320g/342g | 312a |
| 320h/340h | 312c |
| 320h/342h | 312a |

It will be appreciated that in the system 310, various of the ports are designed to have a different number of allowed states. More specifically, with flow of natural gas through the system 310, the flame ports 312b, 312c, 312e and 312g can be in either of two states, i.e., either on or off. The ports 312d and 312f can be in one of three states such that each of the ports 312d and 312f is either off or supplied by one or two different lines. The ports 312a and 312h can be in one of five states such that each of the ports 312a and 312h is either off or supplied by one, two, three or four different lines.

Assuming that the flow through each of the flow lines is the same, it will be appreciated that the flame ports 312a and 312h can, at any one point in time, have up to four times the amount of fuel supplied thereto as supplied to those ports that have only one flow supply line. Consequently, the flame issuing forth from the flame ports 312a and 312h can be up to about four times the nominal height of one of the flame ports having only one flow supply line.

It will be appreciated that many different flow line combinations are possible and the invention is not limited to those flow line combinations shown.

Figure 4:
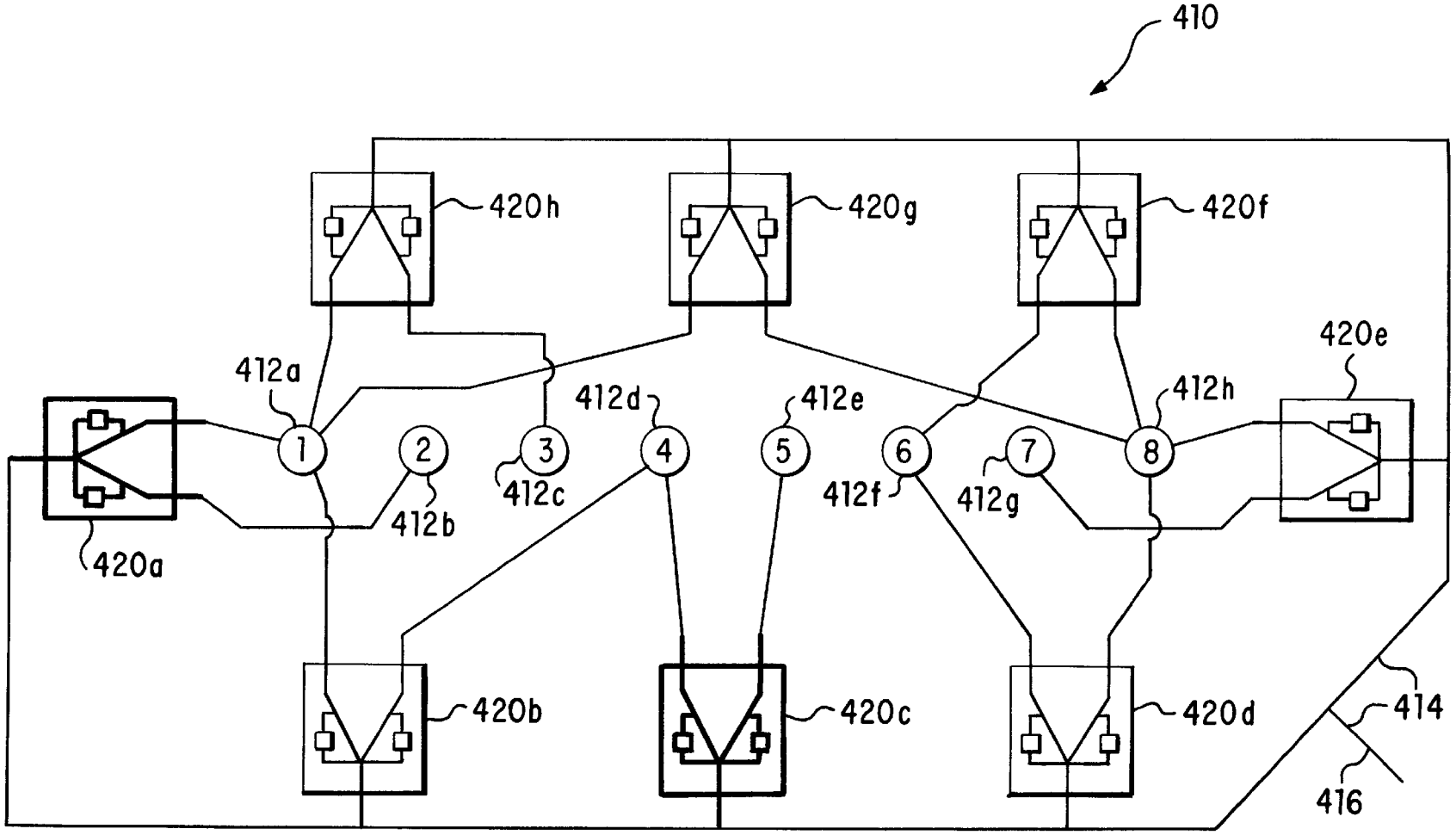
FIG. 4 is a schematic illustration of a system for producing a moving flame in accordance with another embodiment of the invention.

FIG. 4 is a schematic illustration of a system, designated by the reference numeral 410, for producing a moving flame in accordance with another embodiment of the invention. The system 410, similar to the system 310 described above, includes a supply line 414, wherethrough a flowstream 416 of fluid fuel, such as of natural gas is supplied to a plurality of flame ports, individually designated 412(*a–h*).

The system 410 includes eight flow switching devices 420(*a–h*) each of different frequency, such as described above. The flow switching devices 420(*a–h*) are joined in parallel as described above relative to the system 310 shown in FIG. 3 It is to be appreciated, however, that the flow switching devices can be variously alternatively joined in parallel such that the number of possible or allowed states for each of the flame ports can be appropriately selected.

The system 410 differs from the system 310 in that two of the flow switching devices, specifically the flow switching devices 420*a* and 420*c,* are larger than the balance of the flow switching devices and thus permit a higher flow rate of fluid fuel, e.g., natural gas, therethrough. In the illustrated system 410, the higher flow rate in the devices 420*a* and 420*c* is three times the flow rate through the other devices 420*b* and 420(*d–h*) (sometimes referred to as "standard").

Thus, in the system 410, the port 412*a* can be supplied by fuel corresponding to 0, 1, 2, 3, 4, 5 and 6 times the flow through a standard device. Ports 412*b* and 412*e* have allowed states corresponding to 0 and 3. Port 412*d* has allowed states corresponding to 0, 1, 3 and 4.

It will be appreciated that as the total number of allowed states for a particular system increases, the behavior of the flame issuing forth therefrom will appear to become more random. Thus, while from a given starting point it may be possible to predict the state of the flame at any specific later point in time based on the specific flow characteristics and parameters (e.g., size, flow rate therethrough, number of fuel lines supplying a particular port, etc.) of the various flow switching devices, as the number of allowed states becomes relatively large, the normal ability of a person to recognize a pattern diminishes and the behavior of the flame appears to be random.

As described above, to produce apparently random flame movement in accordance with the invention, it is generally desirable that the number of flow switching devices joined in parallel is at least as great as the number of flame ports supplied by the system, i.e., the number of fluid fuel flow switching devices joined or connected in parallel supply an equal or smaller number of flame ports or flame burner locations composed of several flame ports in close proximity. In one preferred form of the invention, the number of fluid fuel flow switching devices joined or connected in parallel exceeds the number of flame ports supplied thereby such as to result in a greater number of possible states for the associated flame ports. It will be appreciated that a system wherein the flame ports have a greater number of fuel supply states can result in the system providing a smoother appearing transition between flame port states, thus resulting in a more natural appearing flame.

While the invention has been described above with reference to the use of flow switching devices in the nature of a fluidic switching device such as a fluidic oscillator or fluidic flip-flop, it is to be understood that the invention, in its broader application is not so limited. It will be appreciated that various forms of flow switching devices can be utilized in the practice of the invention. For example, if desired, the invention can be practiced utilizing flow switching devices such as in the nature of one or more forms of valves as well as various compound assemblies. More particularly, flow switching devices in the nature of valves such as solenoid, pneumatic, hydraulic or piezoelectric valves can be used. Compound assembly fluidic switching devices utilizable in the invention include assemblies of one or more assembly element such as fluid storage volume, a fluid flow resistor and a fluidic devices such as an orifice or needle valve, for example, connected and assembled to a second such element.

Further, while the flow switching devices and particularly the fluidic switching devices utilizable in the invention may include moving parts, in one preferred form of the invention the flow switching devices, such as fluidic switching devices, preferably contain or include no moving parts such as to provide improved reliability.

In order to more closely approximate the flame movement normally realized with a wood-burning fire, it is generally desired that flow switching devices utilized in the practice of the invention alternate flow of the fuel between the two flame ports with a dwell time at each port of between about 0.5 seconds to about 500 seconds, more preferably with a dwell time at each port of between about 0.5 seconds to about 200 seconds and still more preferably with a dwell time at each port of between about 5 seconds to about 100 seconds.

To enhance the production of an apparently random movement of a flame, it is generally desirable that each of two or more flow switching devices joined in parallel have a unique frequency, particularly a unique frequency between 0.0025 and 1 Hz.

The production of an apparently random movement of a flame can be enhanced by a system wherein each flame port is supplied with fuel from the output of at least two fluidic devices.

It will be appreciated that the apparent random nature of the process can be still further enhanced by the normal cycle to cycle variations in the frequency of the flow switching devices such as may occur due to drafts, changes in supply pressure and other second and third order effects.

It is also to be appreciated that several of such systems can be used in combination in a single installation, such as a gas-fired fireplace, to further enhance the random appearing nature of the flame movement.

Thus, the invention provides an apparently random flame pattern such as created with predictably periodic automatic flow switching devices having only two different outputs. As described, the combining or joining in parallel of two or more such devices, such as each having a unique or different frequency can provide for a flame height dependent on the combination of several relatively small inputs from different devices.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for producing a moving flame comprising passing a fluid fuel through a fuel supply system comprising at least a first flow switching device to alternately supply fuel to one of at least two flame ports, wherein the flow switching device is a fluidic switching device.

2. The method of claim 1 wherein the fluid fuel comprises natural gas.

3. The method of claim 1 wherein the fluidic switching device is a fluidic flip-flop.

4. The method of claim 1 wherein the fluidic switching device is a fluidic oscillator.

5. The method of claim 1 wherein the flow switching device alternates flow of the fuel between the at least two flame ports with a dwell time at each port of between about 0.5 seconds to about 500 seconds.

6. The method of claim 1 wherein the flow switching device alternates flow of the fuel between the at least two flame ports with a dwell time at each port of between about 5 seconds to about 100 seconds.

7. The method of claim 1 wherein the fuel supply system comprises at least two flow switching devices joined in parallel to produce an apparently random flame movement.

8. The method of claim 7 wherein the fuel supply system comprises a plurality of flow switching devices joined in parallel and the number of flow switching devices joined in parallel is at least as great as the number of flame ports supplied by the system.

9. The method of claim 7 wherein each of the at least two flow switching devices has a unique frequency between 0.0025 and 1 Hz.

10. The method of claim 1 wherein each flame port is supplied with fuel from the output of at least two fluidic devices.

11. A method for producing an apparently random flame movement for a natural gas-fueled fireplace, said method comprising the steps of:

providing each of a plurality of flame ports with a varying flow of natural gas through a network including a plurality of fluidic switching devices wherein each fluidic switching device is joined in parallel to at least one of the other of the plurality of fluidic switching devices and burning provided natural gas at each of the plurality of flame ports.

12. The method of claim 11 wherein at least one of the plurality of fluidic switching devices is a fluidic flip-flop.

13. The method of claim 11 wherein at least one of the plurality of fluidic switching devices is a fluidic oscillator.

14. A system for producing a moving flame, said system comprising:

at least first and second flame ports supplied with fluid fuel through a network of at least first and second flow switching devices joined in parallel whereby a first output of the first flow switching device is combinable with a first output of the second flow switching device.

15. The system of claim 14 wherein the fluid fuel comprises natural gas.

16. The system of claim 14 wherein said flow switching device is a fluidic switching device.

17. The system of claim 16 wherein the fluidic switching device is a fluidic flip-flop.

18. The system of claim 16 wherein said fluidic switching device is a fluidic oscillator.

19. The system of claim 14 wherein said network alternates flow of the fuel between said at least two flame ports with a dwell time at each port of between about 0.5 seconds to about 500 seconds.

20. The system of claim 14 wherein said network alternates flow of the fuel between said at least two flame ports with a dwell time at each port of between about 5 seconds to about 100 seconds.

21. The system of claim 14 comprising a plurality of flow switching devices joined in parallel with the number of flow switching devices joined in parallel being at least as great as the number of flame ports supplied by said system.

22. The system of claim 14 wherein each of said at least two flow switching devices has a unique frequency between 0.0025 and 1 Hz.

23. In a fireplace having a system wherein natural gas is burned to produce flames at at least first and second flame ports, the improvement of the system comprising:

at least first and second fluidic switching devices joined in parallel to vary the quantity of the natural gas supplied to at least the first and second flame ports at any one time.

24. The system of claim 23 wherein at least one of said at least first and second fluidic switching devices is a fluidic flip-flop.

25. The system of claim 23 wherein at least one of said at least first and second fluidic switching devices is a fluidic oscillator.

26. The system of claim 23 comprising a plurality of fluidic switching devices joined in parallel with the number of said fluidic switching devices being at least as great as the number of said flame ports supplied by said system.

* * * * *